US006062829A

United States Patent [19]

Ognier

[11] Patent Number: 6,062,829

[45] Date of Patent: May 16, 2000

[54] PERISTALTIC PUMP

[76] Inventor: Jean-François Ognier, Aulhac, F-69392 Saignes, France

[21] Appl. No.: 09/011,127

[22] PCT Filed: Jul. 26, 1996

[86] PCT No.: PCT/FR96/01190

§ 371 Date: Jan. 26, 1998

§ 102(e) Date: Jan. 26, 1998

[87] PCT Pub. No.: WO97/05386

PCT Pub. Date: Feb. 13, 1997

[30] Foreign Application Priority Data

Jul. 27, 1995 [FR] France ..... 95 09386

[51] Int. Cl.[7] ..... F04B 43/12

[52] U.S. Cl. ..... 417/477.9; 417/477.7; 604/153

[58] Field of Search ..... 417/477.2, 477.9; 604/153

[56] References Cited

U.S. PATENT DOCUMENTS

| | | | |
|---|---|---|---|
| 2,909,125 | 10/1959 | Daniels . | |
| 4,424,011 | 1/1984 | O'Brien . | |
| 4,631,008 | 12/1986 | Stenner . | |
| 5,230,614 | 7/1993 | Zanger et al. | 417/477.9 |
| 5,433,588 | 7/1995 | Monk . | |
| 5,709,539 | 1/1998 | Hammer et al. | 417/477.3 |

FOREIGN PATENT DOCUMENTS

| | | |
|---|---|---|
| 2 413 095 | 7/1977 | France . |
| 433992 | 8/1965 | Germany . |
| 94 12 228 U | 11/1994 | Germany . |

*Primary Examiner*—Charles G. Freay
*Attorney, Agent, or Firm*—Herbert Dubno

[57] ABSTRACT

A peristaltic pump has a fixed support, a rotor rotatable about a rotor axis on the support, and a plurality of rollers mounted on the rotor rotatable about respective roller axes angularly equispaced about and radially equispaced from the rotor axis. A stator fixedly mounted on the support is formed with a recess having an arcuate floor directed radially inward at the rotor axis and including a main region of constant radius of curvature centered on the rotor axis and an end region of a radius that increases progressively away from the region of constant radius at a uniform rate and that has an angular dimension generally equal to an angular spacing between adjacent roller axes. The recess has an overall angular dimension equal to substantially less than 180°. A tube lying on and extending along the floor is engageable with the rollers so that the rollers form in the tube a series of transfer chambers. The rotor is rotated about the rotor axis so as to displace the transfer chambers from the main region where the transfer chambers are of constant volume to the end region where they are of uniformly increasing volume.

7 Claims, 4 Drawing Sheets

PERISTALTIC PUMP

CROSS-REFERENCE TO RELATED APPLICATIONS

This application is a national stage application under 35USC1.371 of PCT/FR96/01190 filed Jul. 26, 1996.

This application is the US national phase of PCT application PCT/FR96/01190 filed Jul. 26, 1996 with a claim to the priority of French application 95.09386 filed Jul. 27, 1995.

FIELD OF THE INVENTION

The present invention relates to improvements in peristaltic pumps, in particular those devices used in irrigating and aspirating physiological liquids with automatic control of the flow and pressure.

BACKGROUND OF THE INVENTION

The evolution of diagnostic endoscopy toward surgical endoscopy has raised new requirements that must be met by the devices and instruments used. Medical irrigating and aspirating devices belong to this category of equipment.

Initially made for dilating the cavity under observation, then used more recently to dynamically create an "aseptic operating space," these devices had to adapt their characteristics to therapeutic means used by endoscopic surgeons, means that require fast reaction to ensure the safety of the patient.

Peristaltic pumps comprising a flexible transfer tube successively pinched by rollers moving one behind the other in an orbit, in particular rollers carried by a rotor, are frequently used for the transfer and the pressurizing of corrosive or sterile liquids. Whatever their form and the number of rollers, current peristaltic pumps only require that at any instant only two of the rollers be active. The closed space inside the tube of the pump delimited by these two rollers forms the liquid-transfer chamber.

Peristaltic pumps are the preferred type for medical applications, in particular in devices for circulation outside the body or in devices for irrigating surgical cavities, as in urology or arthroscopy where these pumps are now in use. By way of example of the known type of medical device using a peristaltic pump, one can cite the surgical irrigating and aspirating device described in French 2,642,297 and WO 90 08562. Nonetheless these peristaltic pumps available on the market generally deliver a cyclic flow having instantaneous flow variations that can exceed 20 to 30% of the average flow of these pumps. This is shown schematically in the diagram of FIG. 1 where time t is on the abscissa and flow D is on the ordinate.

These flow variations are the result of the variations of volume of the transfer chambers as the rollers disengage and in a more accessory manner of the compression of the transfer tube created by these rollers. Such flow variations can be a considerable inconvenience in surgical applications so that manufacturers of peristaltic pumps resort to the use of pressure-regulating or—smoothing devices at the pump output. These devices are normally passive and are not generally effective except for a given cadence, thus for a relatively restricted range of operation.

U.S. Pat. No. 3,726,613 proposes to suppress the variations of the cyclic flow by a peristaltic pump and an "active" device having a pressurizing element acting variably with respect to time on the transfer tube at the outlet of the pump under the control of an operating device which itself has a cam fixed to the rotor of the pump and acting via an oscillating link on the pressurizing element. This document contains an accurate analysis of the physical problems of the problem, but it describes a solution that, using "active" elements, is mechanically fairly complex and relatively expensive.

In German utility model 94 122 28 there is also a peristaltic pump which attempts to smooth the output flow by means of a widened space of continuously increasing width between the rotor and the stator, from the input to the outlet of the pump in the direction defined by the movement of the rollers. This configuration results in an eccentric orientation of the circular recess of the stator relative to the axis of the rotor.

In any case this document does not explain how the device in question functions and the proposed solution does not appear to work in principle or practice. At least the operation of this device seems to rely on the simultaneous cooperation of a high number of rollers of the rotor with the tube which supposes a deep recessing of the rotor into the stator having as a result difficulties of completely and quickly disengaging the rotor from the stator.

OBJECTS OF THE INVENTION

The present invention is aimed at eliminating these disadvantages by providing an improved peristaltic pump provided with an integrated system for flow control that automatically compensates for variations therein in a simple, easy-to-manufacture, and efficient manner in accordance with a clear operating principle and with great precision and set up so that the rotor can easily be separated from the stator for reasons of safety and interchangeability.

SUMMARY OF THE INVENTION

To this end in the peristaltic pump of the type having a fixed body or stator and a rotor provided on its periphery with rollers between which passes a flexible liquid-transfer tube pinched by at least two succeeding rollers between which is defined a transfer chamber according to the invention in order to make the flow at the pump output generally uniform the fixed body or stator has at the end of a recess of generally constant radius of curvature centered on an axis of the rotor where the transport tube is pinched by the rollers a region of progressively increasing radius, this radius being measured to the axis of the rotor. Preferably the region of progressively increasing radius extends over an angle generally equal to the angle separating two consecutive rollers on the rotor. This setup aims

- on the one hand at spreading the variation of the volume of the transfer chamber over an angle equal to the angle between two consecutive rollers,
- on the other hand at compensating for the nonlinearity of the variation of volume of the transfer chamber relative to the lift height of the roller as it disengages, which constitutes an appreciable advantage relative to German 94 122 28 cited above, and
- finally at compensating for the effect of compression of the rollers on the liquid-transfer tube.

The profile of the stator in the region of progressively increasing radius should be a function of the diameter of the rotor rollers, of the characteristics of the transfer tube used (inside and outside diameters, hardness), and of the pressure exerted by the rollers on the transfer tube, that is the squashing of this tube.

To explain the preceding, the diagram of FIG. 2 shows the variation of volume V of a transfer chamber as a function of the pinching P of the tube. The axis of the abscissa represents the pinching P in mm; the value P=0 corresponding to contact of the roller with the tube without pinching, the value P=5 corresponding to occlusion of the tube, and the value P=5.5 corresponding to a compression of 0.5 mm of the walls of the tube after occluding it. The axis of the ordinate shows in percentage the variation of the volume of a transfer chamber under the effect of the pinching of one roller, in other words the volume occupied by this roller inside the transfer tube. In this example it is more particularly the action of a roller of a diameter of 16 mm on a silicone tube having an outside diameter of 8 mm and an inside diameter of 5 mm, the roller compressing the walls of the tube by at most 0.5 mm. In the free part, that is before complete occlusion of the tube, the curve C of the variation of the volume V relative to the height of the roller takes an approximately parabolic shape. The shape given to the stator in the region of progressively increasing radius takes into account the intrinsic characteristics of the system of the transfer tube and roller shown in FIG. 2 in order to make the variation of volume proportional to the angular variation. Since the variation should be spread over 30°, the pinchings are determined according to the diagram of FIG. 2 such that 1° of angular variation corresponds to 3.33% of variation of volume. The radii thus defined allow one to determine the shape of the stator of the pump projected orthogonally on a plane as show in FIG. 3 where the axis of the abscissa x represents a right-angle tangent to the rotor, the position x=0 corresponds to the median position, that is the plane containing the axis of the rotor, while the axis of the ordinate y represents the depth of the stator (the values indicated being expressed in millimeters). More generally, the variation of the radius is a function determined experimentally into which count the angle, the diameter of the transfer tube, the diameter of the rollers, and the clamping pressure applied on the tube in the region of constant radius. The preceding example is taken up below with the numeric data concerning the values of the radii.

To contribute to avoiding flow variations at the outlet of the pump it is further suggested to provide a rotor of relatively great diameter carrying a relatively large number of rollers and set practically "tangentially" with respect to the stator of the pump. This setup that limits the curvature of the stator in the region where the rollers work has shown itself to be particularly advantageous, not only to limit output variations, but also to facilitate the rapid disengagement of the head of the pump by simply retracting the rotor or the stator which ensures a supplemental level of security. In particular the rotor of the pump can be mounted on a carriage moved by a fluid-powered cylinder, allowing rapid disengagement in the radial direction in the case of an uncontrollable overpressure. The "tangential" orientation allows one to make the stator a detachable and easily replaced part, in fact a part that forms an integral part of a single-use tube and whose characteristics are related to this tube which is important in medical and surgical applications.

Altogether, the apparatus according to the invention provides a simple and economical way to provide at the output of the pump flow and pressure variations which can be ±2% relative to the nominal values.

BRIEF DESCRIPTION OF THE DRAWING

In any case the invention will be better understood with the help of the description that follows with reference to the annexed schematic drawing showing by way of example an embodiment of this peristaltic pump.

SPECIFIC DESCRIPTION

Figure 1:
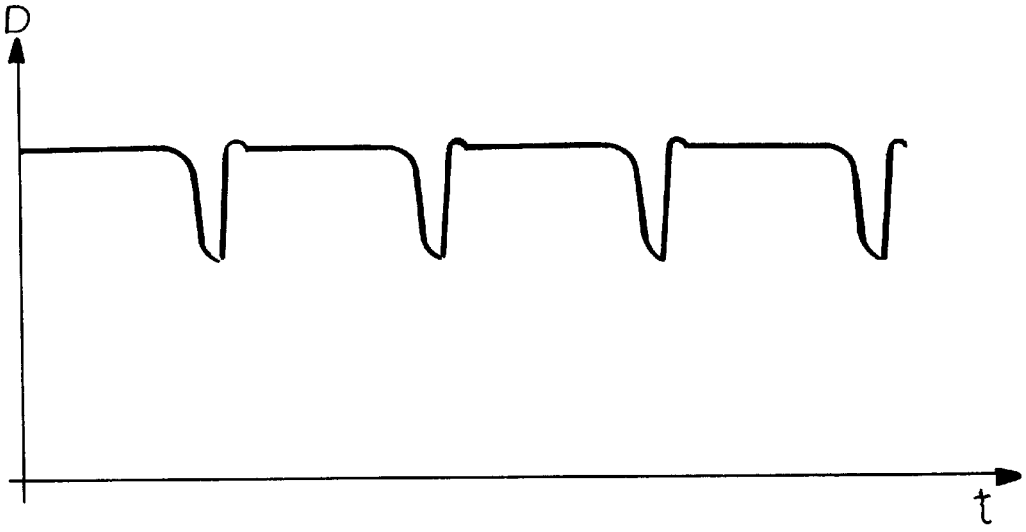
FIG. 1 is a diagram comparing time and flow.
Figure 4:
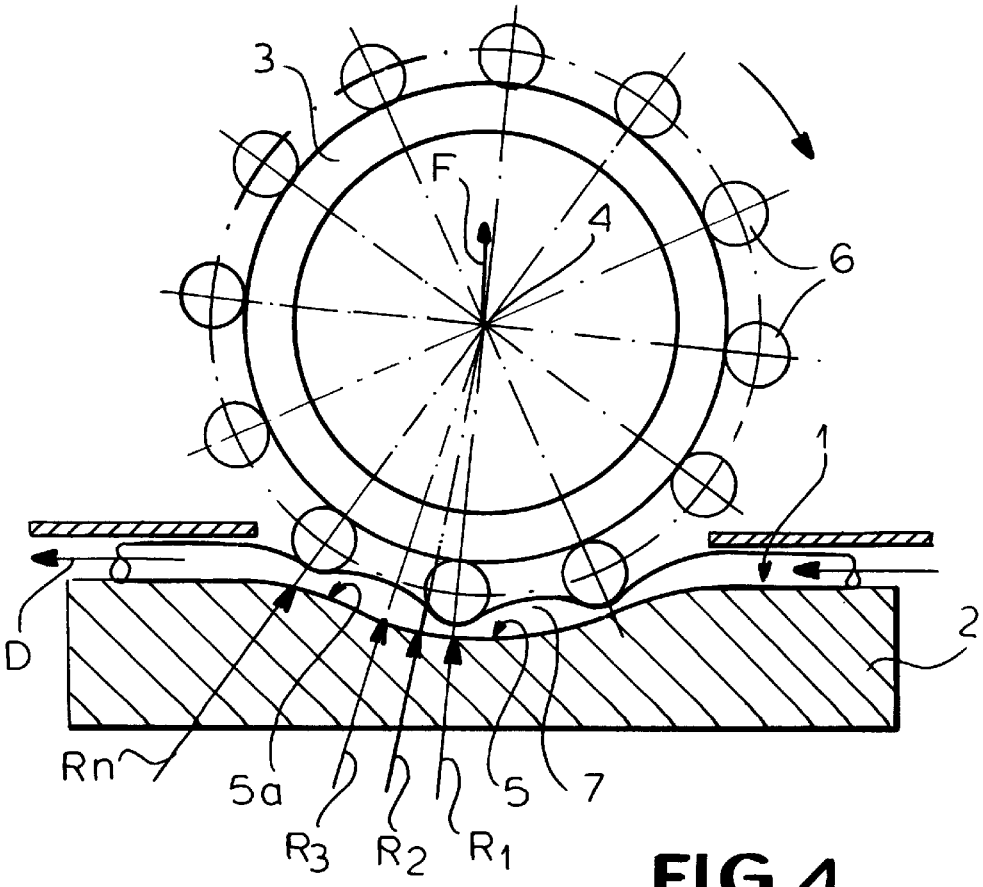
FIG. 4 is a front view partially in section of a peristaltic pump according to the present invention.
Figure 2:
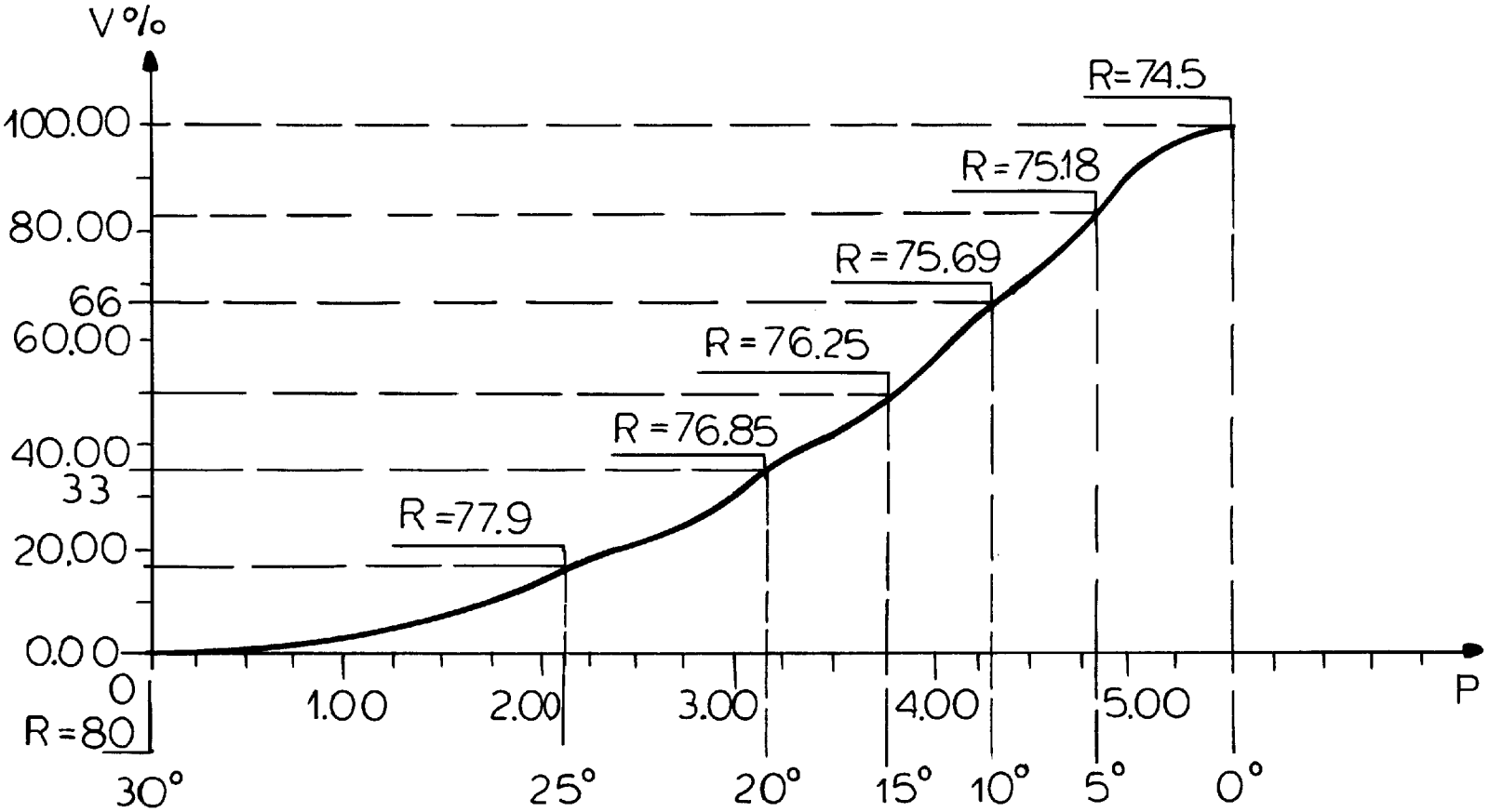
FIG. 2 is a diagram comparing transfer-chamber volume and tube pinching.
Figure 3:
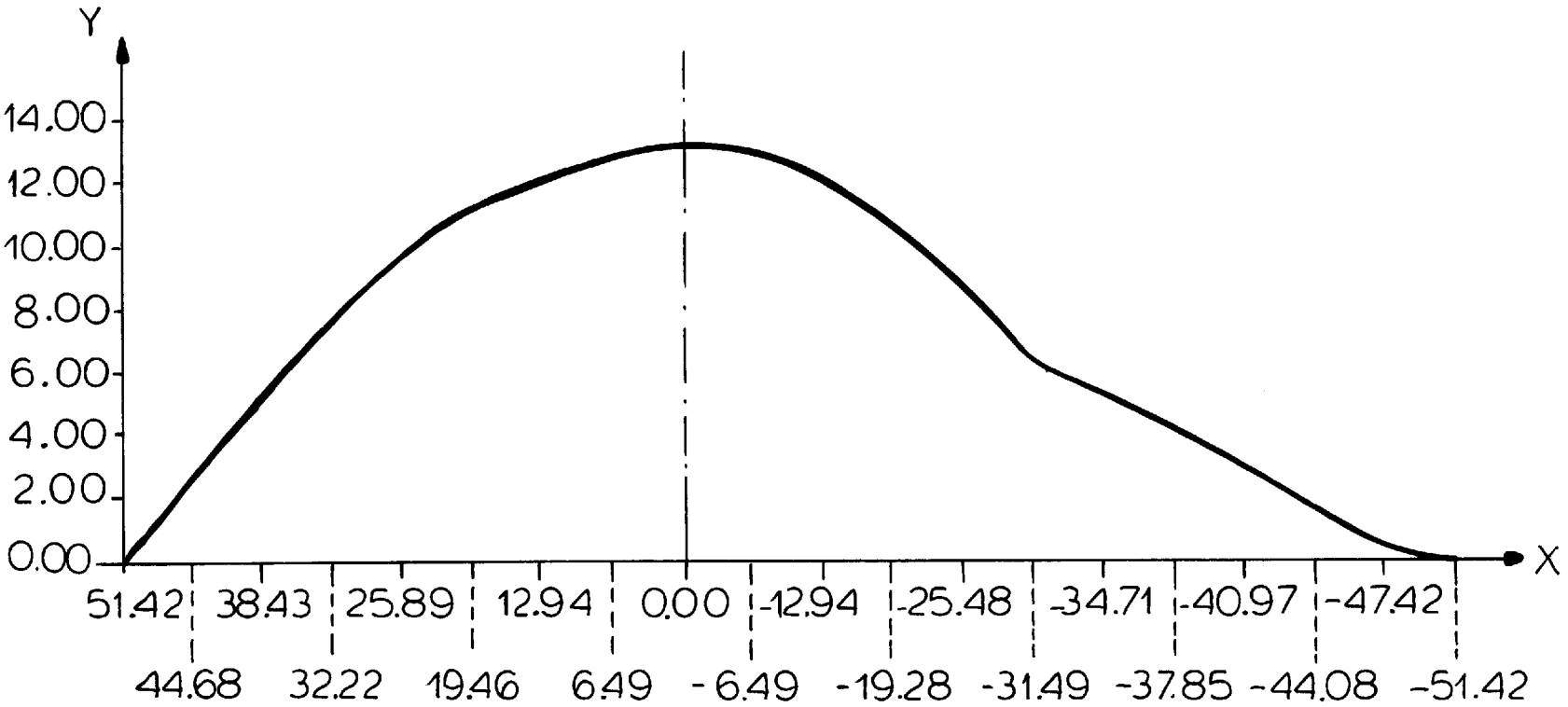
FIG. 3 is a diagram illustrating a pump stator.

FIG. 4 shows very schematically a peristaltic pump which has a flexible transfer tube 1, a fixed body or stator 2, and a generally cylindrical rotor 3 rotatable about an axis 4 orthogonal to the direction of the tube 1. The stator 2 here has a recess 5 of a particular shape described below.

The rotor 3 carries on its periphery a plurality of angularly equispaced rollers 6, for example twelve rollers 6 separated by angles of 30°. In a predetermined region of their orbit the rollers 6 pinch the transfer tube 1, pressing it against the base of the recess 5 of the stator 2. The tube 1 has between two consecutive rollers 6 engaging it a rounded region 7 forming a liquid-transfer chamber, at least two rollers 6 being simultaneously active at any time in the region of constant radius and thus forming a transfer chamber that is closed at both ends.

The recess 5 of the stator 2 extends mainly along a circular arc, that is with a constant radius, having a center of curvature on the axis 4 of the rotor 3. Nonetheless, this recess 5 has a particular profile in a region 5*a* at the side of the output of the liquid, a region which extends over an angle at least equal to the angle separating the rollers 6 (here in the example 30°).

Thus relative to the axis 4 of the rotor 3, the floor of the recess 5 has in the region in question radii R1, R2, R3 . . . Rn that increase progressively. The usable flow cross section for passage of the liquid thus grows downstream which allows one to compensate for the variation of volume that takes place when one of the rollers 6 disengages so as to obtain a liquid flow D that is practically constant at the outlet of the pump.

By way of example, the radii R1, R2, R3, etc described above measured every 5° in the region extending over a total angle of 30° can be the following:

| |
|---|
| R1 = 74.50 mm |
| R2 = 75.18 mm |
| R3 = 75.69 mm |
| R4 = 76.25 mm |
| R5 = 76.85 mm |
| R6 = 77.90 mm |
| R7 = 80.00 mm. |

For a nominal radius of 74.50 mm in a pump whose rotor 3 has an outside diameter of 144 mm and equipped with rollers 6 having a diameter of 16 mm spaced 30° apart, the silicone transfer tube 1 has an outside diameter of 8 mm and an inside diameter of 5 mm and the compression of the walls of this tube 1 in the constant-radius region is 0.5 mm.

As also shown by FIG. 4, the rotor 3 of the peristaltic pump can be completely disengaged from the stator 2 in the radial direction indicated by the arrow F, thus freeing the transfer tube 1 in particular in the event of an uncontrolled overpressure. To this end the rotor 3 is mounted on a carriage displaced by an unillustrated fluid-powered cylinder.

Figure 5:
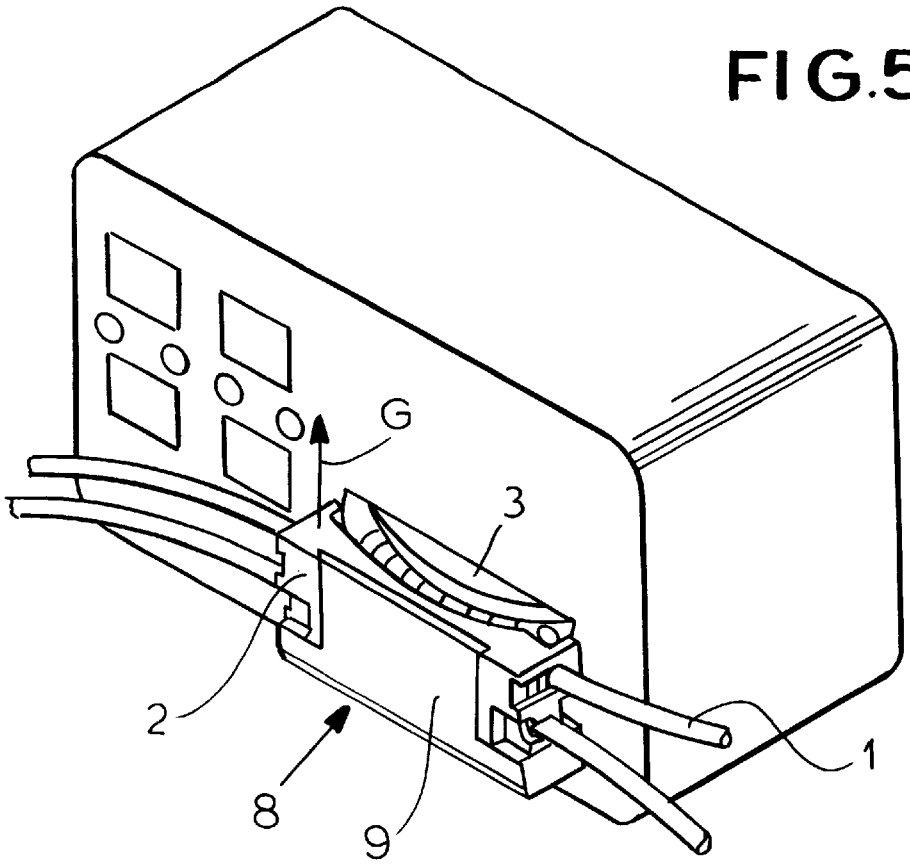
FIG. 5 is a perspective view of an apparatus incorporating the peristaltic pump of FIG. 4.

FIG. 5 shows a control unit for fluids for endoscopic surgery which uses the above-described peristaltic pump and which is generally indicated at 8, with the stator 2 and rotor 3 partially shown. The stator 2 is here formed as a molded detachable part shown alone in FIG. 6 which forms an integral part of a sterile single-use tube 1. This detachable and interchangeable stator 2 is mounted on a support 9 itself fixed to the front of the apparatus.

Figure 6:
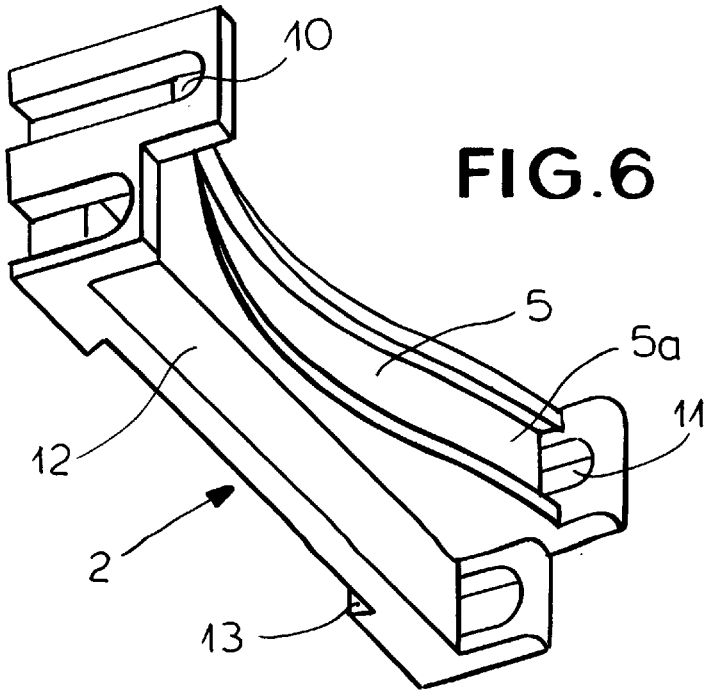
FIG. 6 is a perspective view of the stator of this peristaltic pump made as a detachable part.

As shown more particularly in FIG. 6, the stator 2 has a shaped groove 5, 5*a* receiving the part of the tube 1 that cooperates with the rollers carried by the rotor 3, the longitudinal shape of the groove 5, 5*a* corresponding to the above-given definition. The ends of this groove are formed as input and output eyes 10 and 11 that are traversed by the tube 1 and that hold same in the stator 2. The stator 2 here has a small groove or surface 12 that is straight and that receives a part of the tube which does not cooperate with the rotor 3.

The stator 2 has, on its face opposite the grooves 5, 5*a* and 12, a dove-tail shape 13 which cooperates with a complementary shape formed on the fixed support 9. The detachable mounting of the stator 2 is done with cooperation of these dove-tail shapes and unmounting the stator 2 takes place in the direction indicated by arrow G of FIG. 5.

As is obvious the invention is not limited to the sole embodiment of this peristaltic pump which has been described above by way of example; instead it includes all the variants of embodiment and application using the same principle.

What is claimed is:

1. A peristaltic pump comprising:

a fixed support;

a rotor rotatable about a rotor axis on the support;

a plurality of rollers mounted on the rotor rotatable about respective roller axes angularly equispaced about and radially equispaced from the rotor axis;

a stator fixedly mounted on the support and formed with a recess having an arcuate floor directed radially inward at the rotor axis and including a main region of constant radius of curvature centered on the rotor axis and an end region of a radius that increases progressively away from the region of constant radius at a uniform rate and that has an angular dimension generally equal to an angular spacing between adjacent roller axes, the recess having an overall angular dimension equal to substantially less than 180°;

a tube lying on and extending along the floor and engageable with the rollers, the rollers forming in the tube a series of transfer chambers; and means for rotating the rotor about the rotor axis and thereby displacing the transfer chambers from the main region where the transfer chambers are of constant volume to the end region where they are of uniformly increasing volume.

2. The peristaltic pump defined in claim 1, further comprising means for displacing the rotor axis and the rotor perpendicularly to the rotor axis toward and away from the stator.

3. The peristaltic pump defined in claim 1 wherein the stator is provided with formations coupling it to the tube.

4. The peristaltic pump defined in claim 3 wherein the formations are closed eyes through which the tube passes.

5. The peristaltic pump defined in claim 1 wherein the support and stator are formed with interfitting dovetail formations extending radially of the rotor axis.

6. A peristaltic pump comprising:

a fixed support;

a rotor rotatable about a rotor axis on the support;

a plurality of rollers mounted on the rotor rotatable about respective roller axes angularly equispaced about and radially equispaced from the rotor axis;

a stator fixedly mounted on the support and formed with a recess having an arcuate floor directed radially inward at the rotor axis and including a main region of constant radius of curvature centered on the rotor axis and an end region of a radius that increases progressively away from the region of constant radius at a uniform rate;

a tube lying on and extending along the floor and engageable with the rollers, the rollers forming in the tube a series of transfer chambers;

means including formations on the stator engaging around and capturing the tube for integrating the tube with the stator; and means for rotating the rotor about the rotor axis and thereby displacing the transfer chambers from the main region where the transfer chambers are of constant volume to the end region where they are of uniformly increasing volume.

7. A peristaltic pump comprising:

a fixed support;

a rotor rotatable about a rotor axis on the support;

a plurality of rollers mounted on the rotor rotatable about respective roller axes angularly equispaced about and radially equispaced from the rotor axis;

a stator fixedly mounted on the support and formed with a recess having an arcuate floor directed radially inward at the rotor axis and including a main region of constant radius of curvature centered on the rotor axis and an end region of a radius that increases progressively away from the region of constant radius at a uniform rate;

a tube lying on and extending along the floor and engageable with the rollers, the rollers forming in the tube a series of transfer chambers;

interfitting dovetail formations extending radially of the rotor axis on the stator and support; and means for rotating the rotor about the rotor axis and thereby displacing the transfer chambers from the main region where the transfer chambers are of constant volume to the end region where they are of uniformly increasing volume.

* * * * *